US006168559B1

(12) United States Patent
Simmons

(10) Patent No.: US 6,168,559 B1
(45) Date of Patent: Jan. 2, 2001

(54) CUSHIONING CONVERSION MACHINE INCLUDING A PAD-TRANSFERRING ASSEMBLY

(75) Inventor: James A. Simmons, Painesville Township, OH (US)

(73) Assignee: Ranpak Corp., Concord Township, OH (US)

( * ) Notice: Under 35 U.S.C. 154(b), the term of this patent shall be extended for 0 days.

(21) Appl. No.: 08/154,911

(22) Filed: Nov. 19, 1993

(51) Int. Cl.[7] ..... B31F 1/10

(52) U.S. Cl. ..... 493/352; 493/407; 493/440; 493/446; 493/464; 493/967

(58) Field of Search ..... 493/407, 439, 493/440, 446, 447, 464, 967, 352; 83/155, 166, 167; 414/794.4, 794.7, 792.7

(56) References Cited

U.S. PATENT DOCUMENTS

| | | | | |
|---|---|---|---|---|
| 2,101,170 | | 12/1937 | Engel | 271/76 |
| 2,569,589 | | 10/1951 | Trissell | 242/86.52 |
| 2,882,802 | | 4/1959 | Walker | 93/1 |
| 3,069,107 | | 12/1962 | Hirt | 242/79 |
| 3,238,852 | | 3/1966 | Schur | 93/1 |
| 3,425,184 | | 2/1969 | Heliot | 53/78 |
| 3,509,797 | * | 5/1970 | Johnson | 493/464 |
| 3,550,493 | * | 12/1970 | Benbenek | 83/155 |
| 3,603,216 | | 9/1971 | Johnson | 93/1 WZ |
| 3,650,419 | | 3/1972 | Upshur et al. | 214/38 B |
| 3,695,133 | | 10/1972 | Finke | 83/204 |
| 3,709,756 | * | 1/1973 | Watson | 414/794.4 |
| 3,949,856 | | 4/1976 | Ulber et al. | 197/133 R |
| 4,026,198 | | 5/1977 | Ottaviano . | |
| 4,085,662 | * | 4/1978 | Ottaviano | 493/464 |
| 4,109,040 | | 8/1978 | Ottaviano . | |
| 4,237,776 | | 12/1980 | Ottaviano . | |
| 4,462,287 | * | 7/1984 | Weis et al. | 83/155 |
| 4,557,716 | | 12/1985 | Ottaviano . | |
| 4,650,456 | | 3/1987 | Armington . | |
| 4,699,031 | * | 10/1987 | D'Angelo | 83/155 |
| 4,717,613 | | 1/1988 | Ottaviano . | |
| 4,750,896 | | 6/1988 | Komaransky et al. . | |
| 4,884,999 | | 12/1989 | Baldacci | 493/439 |
| 4,968,291 | | 11/1990 | Baldacci et al. . | |
| 5,088,972 | * | 2/1992 | Parker | 493/464 |
| 5,123,889 | | 6/1992 | Armington | 493/35 R |
| 5,292,238 | * | 3/1994 | Michalak | 83/155 |
| 5,322,477 | | 6/1994 | Armington et al. | 493/346 |

FOREIGN PATENT DOCUMENTS 274188 12/1989 (DE) .

OTHER PUBLICATIONS

Photo, Fasson Machine Systems ADV #2–059, LM, Nov. 1985.

"Dorner 2100 Series Alloy Conveyors", Catalog 2100B, Dorner Manufacturing Corporation.

* cited by examiner

*Primary Examiner*—Peter Vo
(74) *Attorney, Agent, or Firm*—Renner, Otto, Boisselle & Sklar, LLP

(57) ABSTRACT

A cushioning conversion machine (10) comprising conversion assemblies (52, 54) which convert a sheet-like material (22) into a continuous strip (30) of a cushioning product; a cutting assembly (56) which cuts a leading portion of the strip (30) into a cut pad (32) of a desired length; and a pad-transferring assembly (12). The pad-transferring assembly (12) is mounted to the machine's frame (36) downstream of the cutting assembly (56) and it is designed to engage the leading portion of the strip (30) prior to it being cut. Once the strip (30) is cut, and the pad (32) is formed, the pad-transferring assembly (12) transfers the cut pad (32) away from the cutting assembly (56).

8 Claims, 9 Drawing Sheets

CUSHIONING CONVERSION MACHINE INCLUDING A PAD-TRANSFERRING ASSEMBLY

FIELD OF THE INVENTION

This invention relates generally as indicated to a cushioning conversion machine including a pad-transferring assembly. More particularly, the invention relates to a pad-transferring assembly which provides a positive, mechanical means for transferring a cut cushioning pad away from the other components of the machine.

BACKGROUND AND SUMMARY OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; and 4,968,291. (These patents are all assigned to the assignee of the present invention and their entire disclosures are hereby incorporated by reference.) Such a cushioning conversion machine converts sheet-like stock material, such as paper in multi-ply form, into low density cushioning pads.

A cushioning conversion machine, such as those disclosed in the above-identified patents, may include a stock supply assembly, a forming assembly, a gear assembly, and a cutting assembly, all of which are mounted on the machine's frame. During operation of such a cushioning conversion machine, the stock supply assembly supplies the stock material to the forming assembly. The forming assembly causes inward rolling of the lateral edges of the sheet-like stock material to form a continuous strip having lateral pillow-like portions and a thin central band. The gear assembly pulls the stock material through the machine and also coins the central band of the continuous strip to form a coined strip. The coined strip travels downstream to the cutting assembly which cuts the coined strip into pads of a desired length.

Typically, the cut pad is transferred downstream to a transitional zone (e.g., a table, a conveyor belt, a bin etc.) and is thereafter removed from the transitional zone and inserted within a container for cushioning purposes. In the past, the transitional zone has been positioned beneath the cutting assembly whereby gravity caused the pad to fall towards the transitional zone, or, in other words, away from the cutting assembly. Additionally or alternatively, the approaching coined strip would urge the cut pad in this direction.

The practice of depending upon the force of gravity and/or the urging of the approaching strip for pad-transferring purposes has, for the most part, been very successful. Nevertheless, applicant appreciated that in certain circumstances (such as high/constant volume cushioning situations), pad-transfer problems sometimes, albeit very rarely, occurred. For example, because of the lightweight nature of the pad, one would occasionally fail to travel downstream to the transitional zone. While, in most instances, the approaching pads would eradicate this failure by pushing the "stalled" pad downstream, periodically the approaching pads would instead "shingle" (i.e., the pads would stack one on top of the other in a shingle-like arrangement). Such shingling (although itself uncommon) would usually result in the "jamming" the cushioning conversion machine and this jamming would almost always translate into machine downtime.

Accordingly, applicant developed the pad-transferring assembly of the present invention to ensure that each and every pad is properly transferred to the transitional zone. Thus, in contrast to the conventional technique of depending upon the force of gravity and/or the urging of the approaching strip for pad-transferring purposes, applicant's invention provides a positive, mechanical means for transferring pads to the transitional zone.

More particularly, the present invention provides a cushioning conversion machine comprising conversion assemblies, a cutting assembly, and a pad-transferring assembly. The conversion assemblies are mounted to the machine's frame and convert the sheet-like stock material into a continuous strip of cushioning product. The cutting assembly is mounted to the frame downstream of the conversion assemblies and cuts a leading portion of the strip into a cut pad of a desired length. The pad-transferring assembly is mounted to the frame downstream of the cutting assembly and transfers the cut pad (formed when the strip is cut) away from the cutting assembly. Preferably, the pad-transferring assembly is a conveyor which frictionally engages the leading portion of the strip prior to it being cut and which frictionally transfers the cut pad away from the cutting assembly. More preferably, the conveyor engages the upper surface of the strip and the upper surface of the cut pad.

These and other features of the invention are fully described and particularly pointed out in the claims. The following descriptive annexed drawings set forth in detail one illustrative embodiment, this embodiment being indicative of but one of the various ways in which the principles of the invention may be employed.

DETAILED DESCRIPTION

Figure 1:
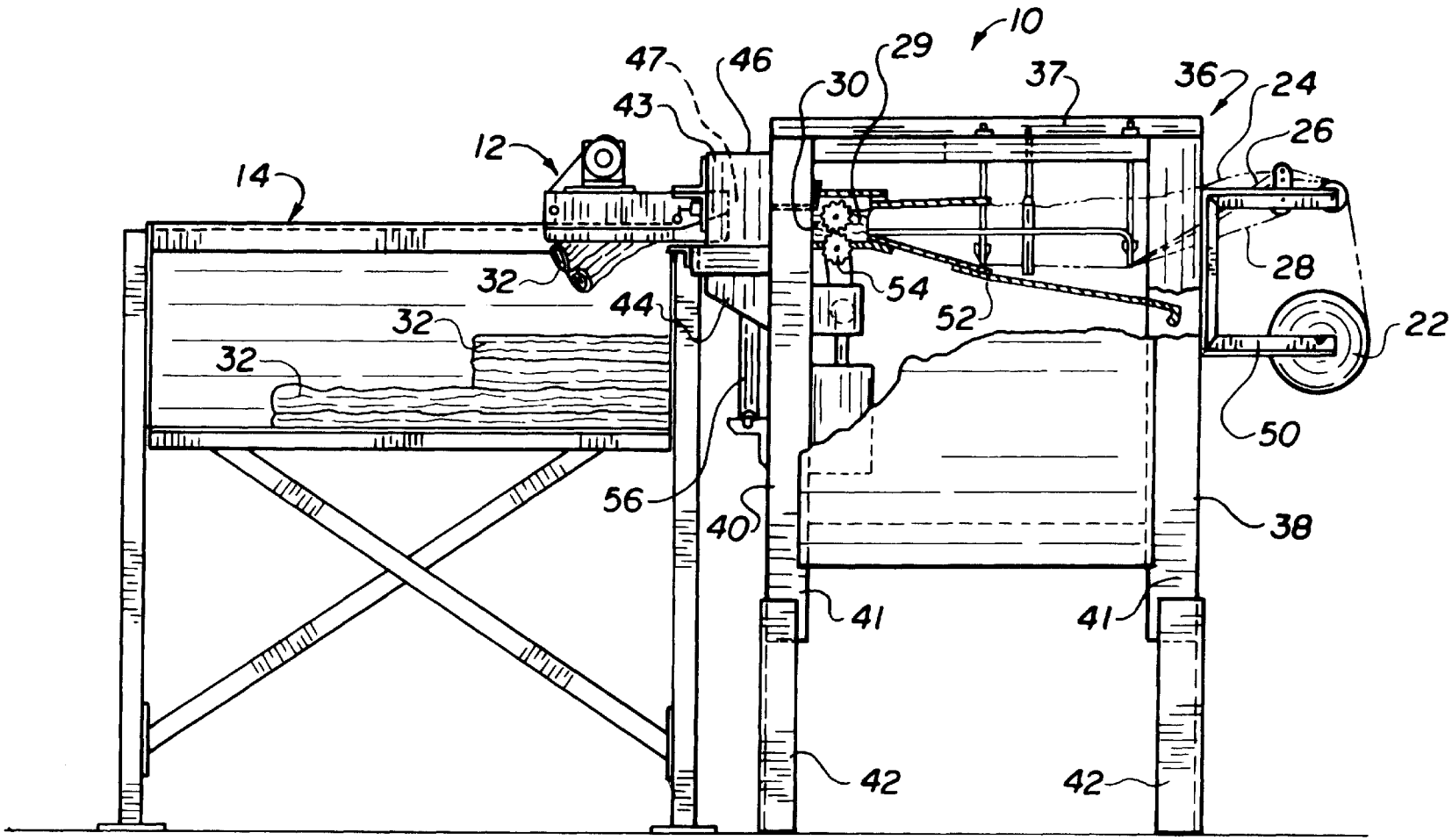
FIG. 1 is a side view of a cushioning conversion machine according to the present invention, the machine incorporating a pad-transferring assembly which transfers pads to a transition zone.

Referring now to the drawings in detail and initially to FIG. 1, a cushioning conversion machine 10 according to the present invention is shown. The machine 10 incorporates a pad-transferring assembly 12 which, as explained in more detail below, transfers pads to a transition zone 14. In contrast to the conventional technique of depending upon the force of gravity and/or the urging of the approaching strip for pad-transferring purposes, the pad-transferring assembly 12 provides a positive, mechanical means for transferring pads to the transitional zone 14.

In the illustrated embodiment, the transitional zone 14 is a slide, such as the one disclosed in a U.S. Patent Application to Beierlozer which is being filed concurrently herewith and which is entitled "Transitional Slide for Use With a Cushion-Creating Machine. However, the present invention can be used with any appropriate transition zone, such as, for example, a horizontal packing surface, a conveyor belt or a bin. In fact, applicant contemplates that the present invention could be used to transfer a pad directly to a container for cushioning purposes.

In FIG. 1, the machine 10 is shown loaded with a roll of sheet-like stock material 22. The stock material 22 may consist of three superimposed webs 24, 26, and 28 of biodegradable, recyclable and reusable thirty-pound Kraft paper rolled onto a hollow cylindrical tube. The machine 10 converts this stock material 22 into a continuous unconnected strip 29 having lateral pillow-like portions separated by a thin central band. This strip is connected or coined along the central band to form a coined strip 30 which is cut into pads 32 of a desired length.

The machine 10 has a frame 36 which includes a self-standing portion 37 having an upstream end 38 and a downstream end 40. (The terms "upstream" and "downstream" in this context are characteristic of the direction of flow of the stock material 22 through the machine 10.) In the illustrated embodiment, the frame portion 37 includes four legs 41 (only two of which are visible in the illustrated orientation). Additionally, in the illustrated embodiment, "stilts" 42 are provided so that the height of the machine 10 is appropriate for the transitional zone, or slide, 14.

The frame 36 further comprises an extension 43 attached to the downstream end 40 of the self-standing frame portion 37. The extension 43 includes a horizontal shelf 44, and a casing 46 which, together with the shelf 44, forms a rectangular tunnel 47. (The casing 46 may be seen in more detail by referring briefly to FIG. 9.)

The machine 10 further includes a stock supply assembly 50, a forming assembly 52, a gear assembly 54, and a cutting assembly 56, all of which are mounted on the frame 36. Specifically, the stock supply assembly 50 is mounted to the upstream end 38 of the self-standing frame portion 37; the forming assembly 52 is mounted on the frame portion 37 downstream of the stock supply assembly 50; and the gear assembly 54 is mounted on the frame portion 37 downstream of the forming assembly 52.

The cutting assembly 56 is mounted on both the self-standing frame portion 37 and the frame extension 43, with its "cutting element" (i.e, its blade 57 which may be seen by referring briefly to FIG. 7) being positioned within the tunnel 47. The pad-transferring assembly 12 is mounted to the frame extension 43, and as is best seen by referring briefly to FIG. 7, a portion of the pad-transferring assembly 12 is positioned within the tunnel 47, just downstream of the blade 57 of the cutting assembly 56.

During operation of the machine 10, the stock supply assembly 50 supplies the stock material 22 to the forming assembly 52. The forming assembly 52 causes inward rolling of the lateral edges of the sheet-like stock material 22 to form the lateral pillow-like portions of the continuous strip 29. The gear assembly 54 pulls the stock material 22 downstream through the machine and also coins the central band of the continuous strip 29 to form the coined strip 30. As the coined strip 30 travels downstream from the gear assembly 54, the cutting assembly 56 cuts the strip into pads 32 of a desired length. The pad-transferring assembly 12 then transfers these pads 32 to the transitional zone 14.

Figure 2A:
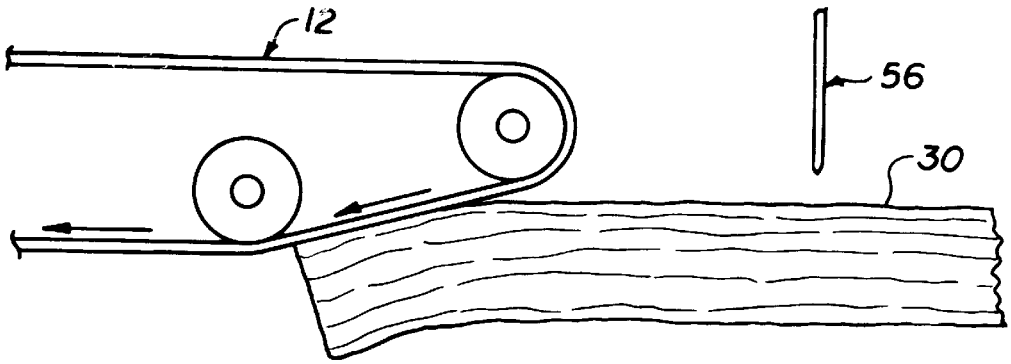
FIGS. 2A–2C are schematic views of the operation of the pad-transferring assembly.
Figure 2B:
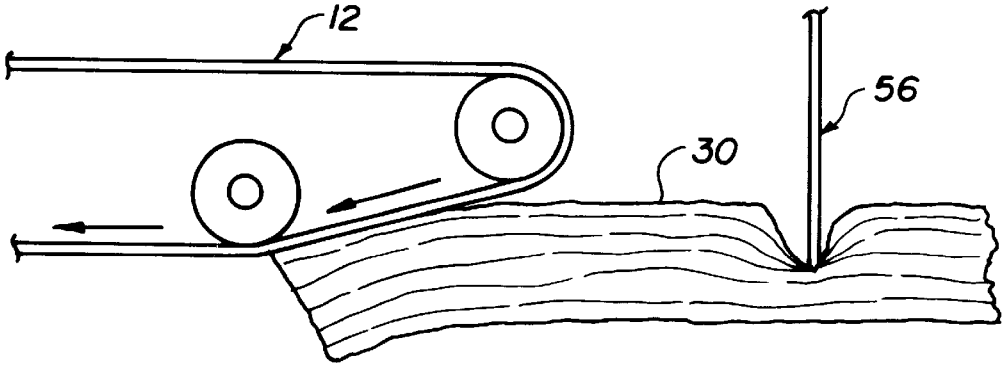
Figure 2C:
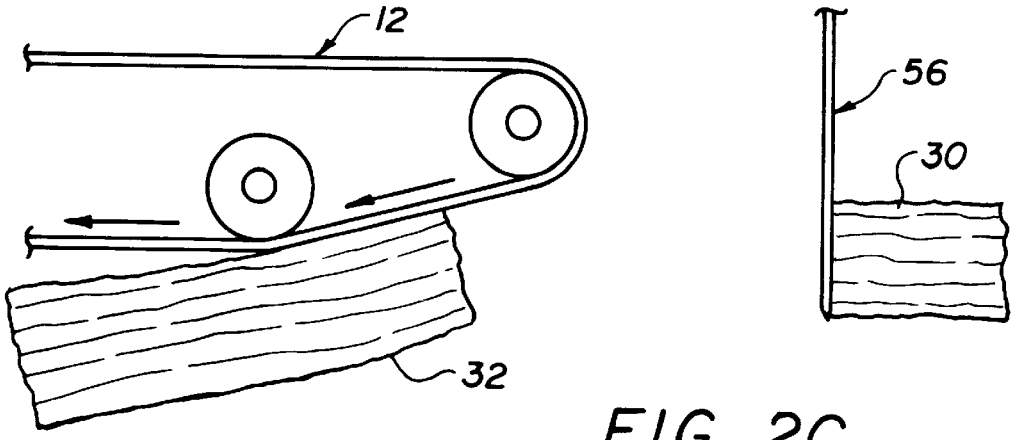
Figure 3:
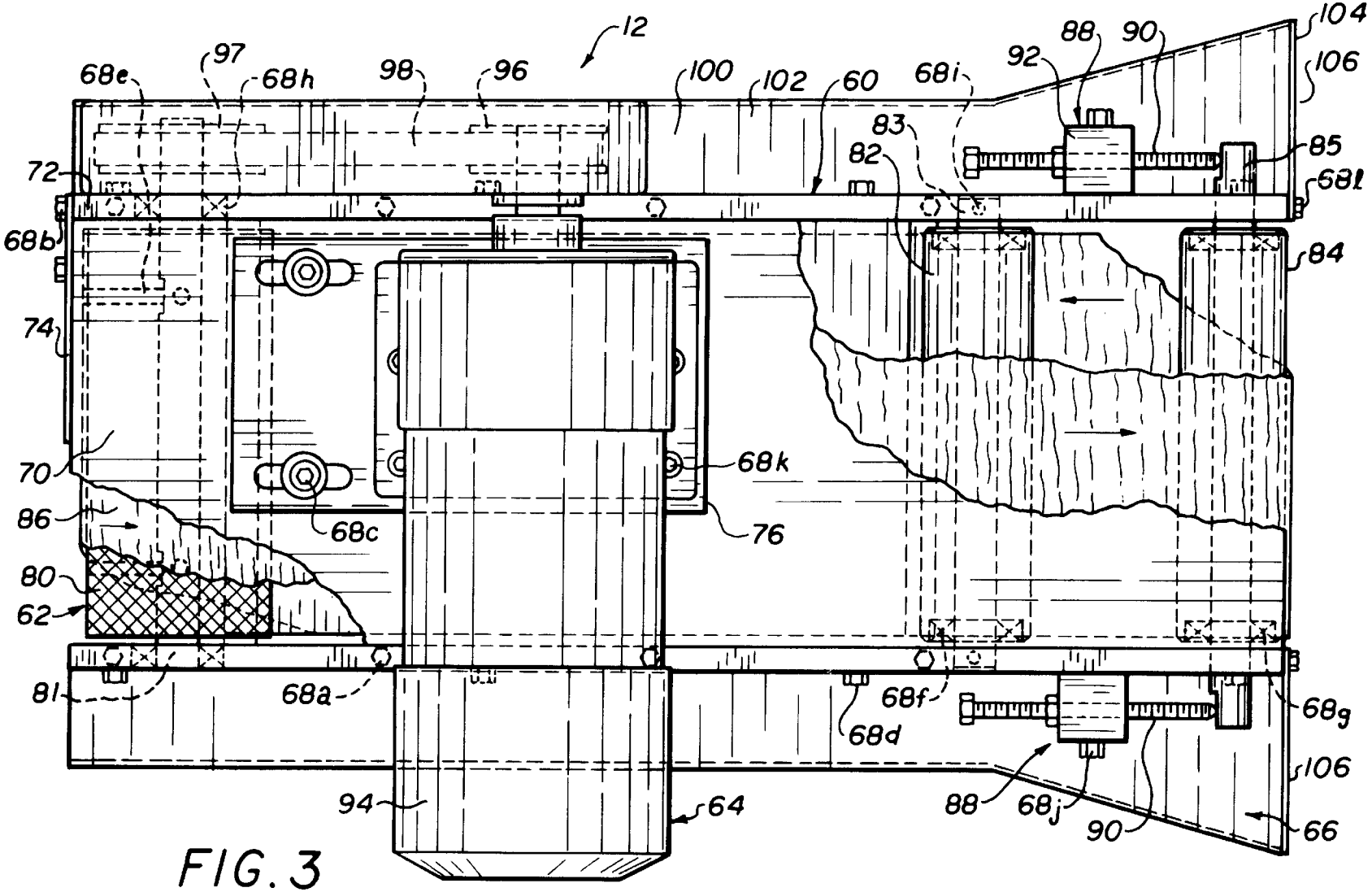
FIG. 3 is a top, isolated, view of the pad-transferring assembly.

As is best shown in schematic illustrations 2A–2C, the pad-transferring assembly 12 is designed to frictionally engage (or "grab") the leading end of the coined strip 30 prior to it being cut. (See FIG. 2A.) As the coined strip 30 is being cut, the pad-transferring assembly 12 continues to frictionally engage the leading edge of the coined strip 30. (See FIG. 2B.) Once the strip 30 is completely cut, and the cut pad 32 is created, the pad-transferring assembly 12 immediately transfers the cut pad 32 towards the transitional zone 14, or, in other words, away from the cutting assembly 56. (See FIG. 2C.) Preferably, and as shown, it is the upper surface of the strip 30 and the upper surface of the cut pad 32 which are frictionally engaged during the transferring process.

Referring now to FIGS. 3–6, the pad-transferring assembly 12 is illustrated isolated from the other assemblies of the machine 10. As shown, the pad-transferring assembly 12 comprises a support structure 60, a conveyor 62, a drive unit 64, a guide chute 66, and a series of coupling elements **68*a*–68*l***.

The support structure 60 includes a top plate 70, two side plates 72, two guard plates 74, a motor-mounting plate 76, and a back-up plate 78. The top plate 70 is sized/shaped to cover the upper surface of the conveyor 62. (See FIG. 3.) The side plates 72, which are attached to the lateral edges of the top plate 70 by capscrews **68*a*, are sized/shaped to cover the lateral surfaces of the conveyor 62. It may be noted for future reference that each side plate 72 includes an open elongated slot 79. (See FIG. 4**.)

The guard plates 74 are attached to the upstream/downstream edges of the top plate 70 by capscrews **68*b* and they are sized/shaped to shield the space between the top plate 70 and the conveyor 62. (See FIG. 3.) The motor-mounting plate 76 is attached to the upper surface of the top plate 70 by capscrews 68*c* and, as the name implies, it is sized/shaped to mount a motor. The back-up plate 78 is attached to the lower edges of the side plates 72 by capscrews 68*d*. (See FIGS. 4 and 5.) For ease in explanation, the description of the size, shape and purpose of the back-up plate 78 will be discussed below in connection with the conveyor 62**.

Figure 4:
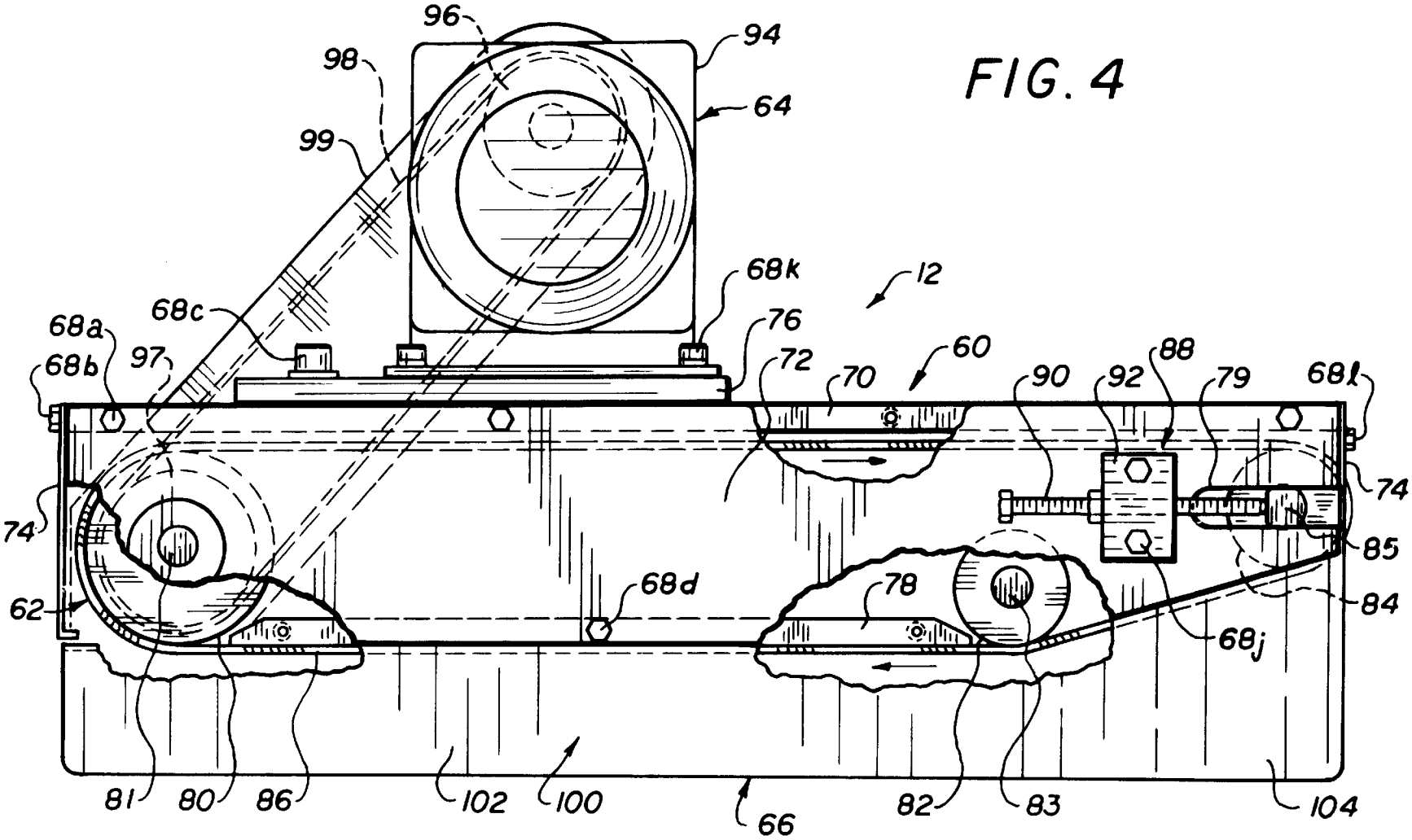
FIG. 4 is a side, isolated, view of the pad-transferring assembly.
Figure 5:
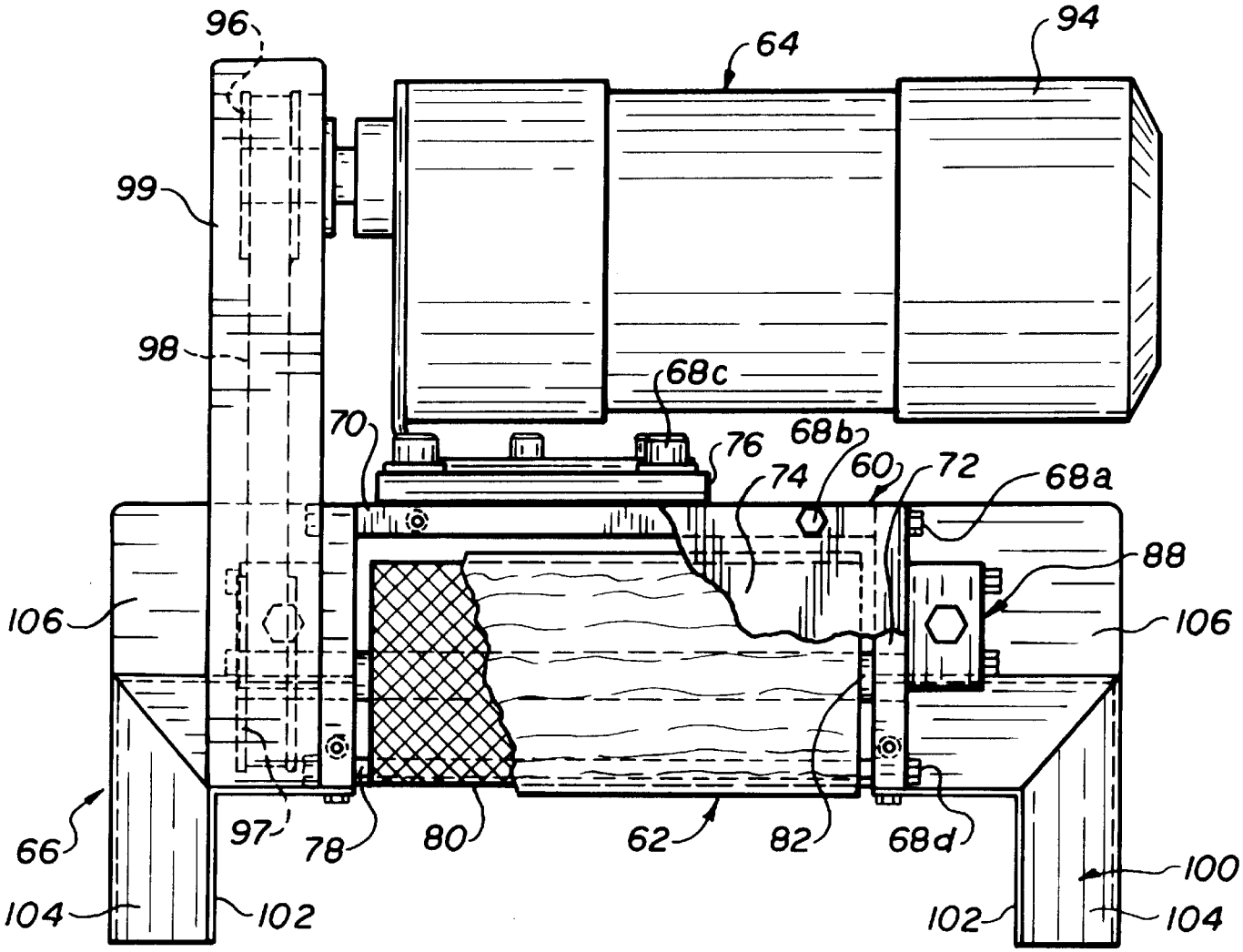
FIG. 5 is a front (downstream), isolated, view of the pad-transferring assembly.
Figure 6:
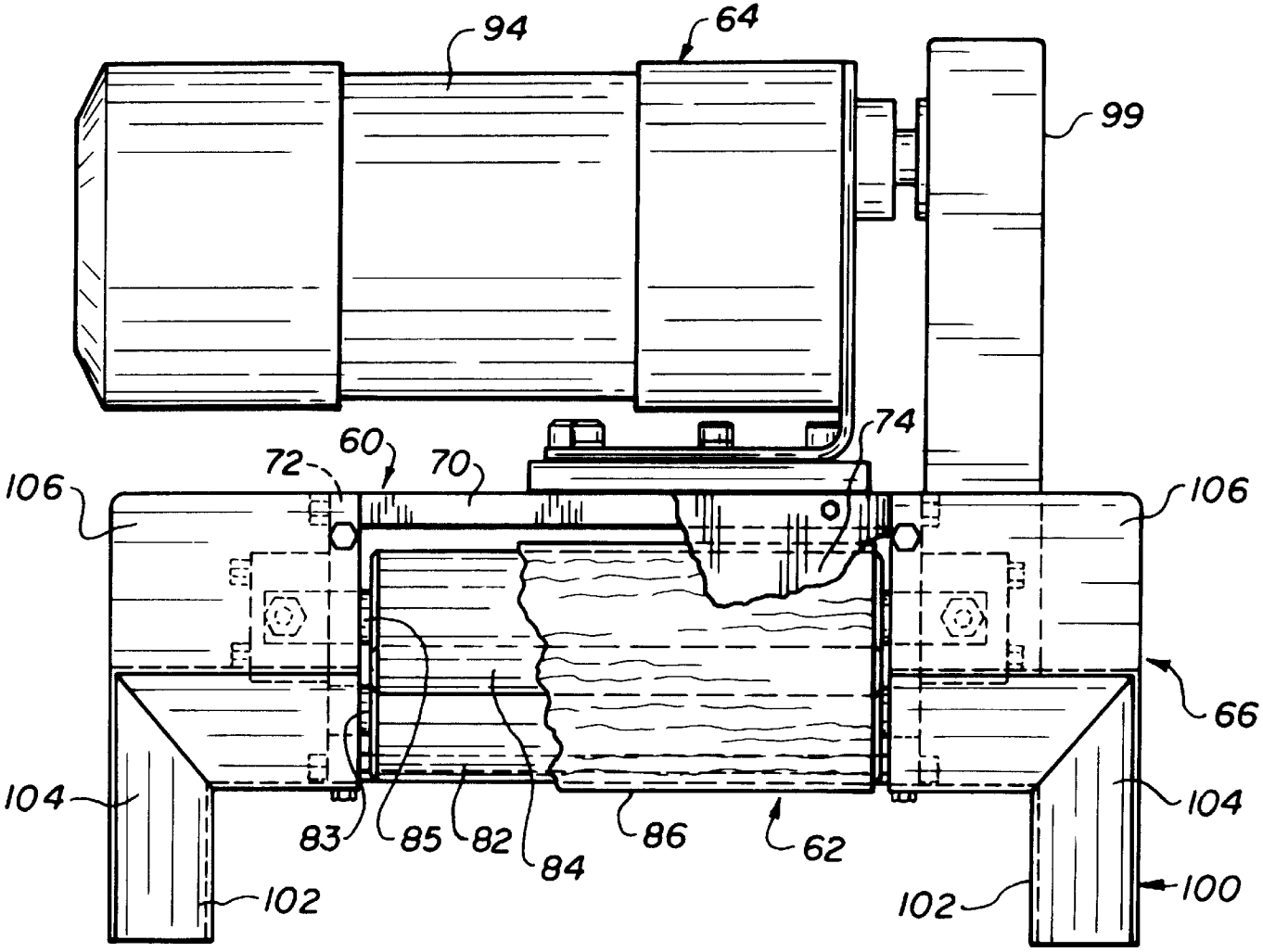
FIG. 6 is a rear (upstream), isolated, view of the pad-transferring assembly.

The conveyor 62 includes a drive roller 80 non-rotatably mounted on a drive shaft 81 by setscrews 68*e,* an idler roller 82 rotatably mounted on an idler shaft 83 by bearings 68*f,* a take-up roller 84 rotatably mounted on a take-up shaft 85 by bearings 68*g,* and an endless belt 86 wrapped around the rollers 80, 82, and 84. The drive shaft 81 is rotatably mounted to the side plates 72 by bearings 68h and the idler shaft 83 is non-rotatably mounted to the side plates 72 by setscrews 68*i.* As is best seen in FIG. 4, both ends of the take-up shaft 85 extend outwardly from the side plates 72 through the elongated slots 79 and the shaft 85 non-rotatably held this position, as is explained in more detail below. It may be noted for future reference that one end of the drive shaft 81 extends outwardly from a side plate 72. (See FIG. 3.)

Returning now to the back-up support plate 78, it is positioned between the drive roller 80 and the idler roller 82, and just above the belt 86. (See FIG. 4.) Accordingly, it is sized/shaped for this positioning. During operation of the conveyor 62, the back-up plate 78 provides an upper support surface for the endless belt 86.

The conveyor 62 may additionally comprise an adjustment mechanism 88 for selectively adjusting the tension and/or the longitudinal orientation of the belt 86. (Additionally, the mechanism 80, along with the belt 86, function to nonrotatably mount the take-up shaft 85 to the side plates 72.) The adjusting elements of the mechanism 88 are a pair of threaded rods 90 which interact with the flattened ends of the take-up shaft 85 to adjust their point of insertion through the slots 79. The rods 90 extend through threaded bores in blocks 92 which are coupled to the side plates 72 by capscrews 68*j.* The threaded arrangement between the rods 90 and the blocks 92 allows controlled and concise adjustments by "screwing/unscrewing" the rods 90. (See FIGS. 3 and 4.)

The drive unit 64 includes a motor 94, which is mounted to the motor mounting plate 76 by capscrews 68k and thus is mounted to the top support plate 70. The drive unit 64 also includes components for transferring the rotational power of the motor 94 to the conveyor 60. More specifically, these components transfer rotational motion to the drive roller 80 which in turn rotates the conveyor belt 86, and thus, the idler roller 82 and the take-up roller in the appropriate direction. (In the orientation shown in FIG. 4, this direction is clockwise.) The illustrated transfer components comprise a pulley 96 which is attached to the motor shaft, a pulley 97 which is attached to one end of the drive shaft 81 (i.e, the end which extends through the side plate 72), and a belt 98 wrapped around the pulleys 96 and 97. The drive unit 64 may additionally include a belt guard 99 to shield the motor belt 98 from external interferences.

The guide chute 66 comprises two tracks 100 symmetrically positioned to form a bottomless channel below the conveyor 62 for the cut pads 32 to travel through during the transferring process. (It should be noted at this point that the "bottom" of the bottomless channel could be partially or totally covered if desirable for a particular application.) The tracks 100 each include a downstream section 102 and an upstream section 104, both sections having an "upside-down L" cross sectional geometry. Each track's downstream section 102 has uniform cross section geometry and each track's upstream section 104 is flared (both outwardly and upwardly) towards its upstream edge. (See FIGS. 5 and 6.) In this manner, the bottomless channel has a relatively wide entrance for the initial insertion of the leading edge of the coined strip 30 and/or the cut pad 32. The guide chute 66 further comprises two vertical flanges 106, one for each track 100, which project from the top upstream edge of the track 100. The inner edges of the flanges 106 are coupled to the upstream edges of the side plates 72 by capscrews 681 to thereby couple the guide chute 66 to the support structure 60. (See FIGS. 3 and 6.)

Figure 7:
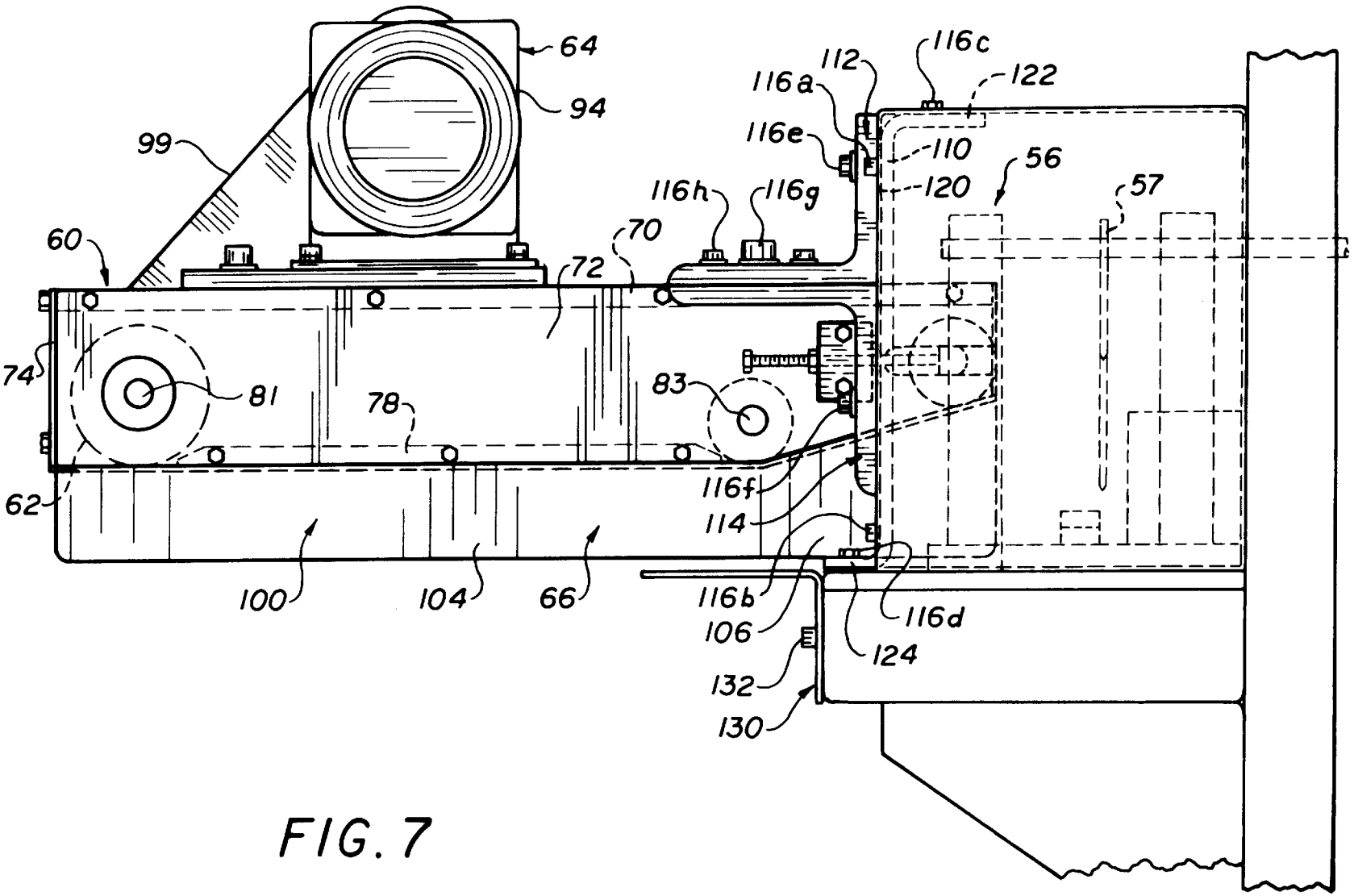
FIG. 7 is a side view of the pad-transferring assembly, the assembly being shown mounted to the cushioning conversion machine by appropriate mounting members.
Figure 8:
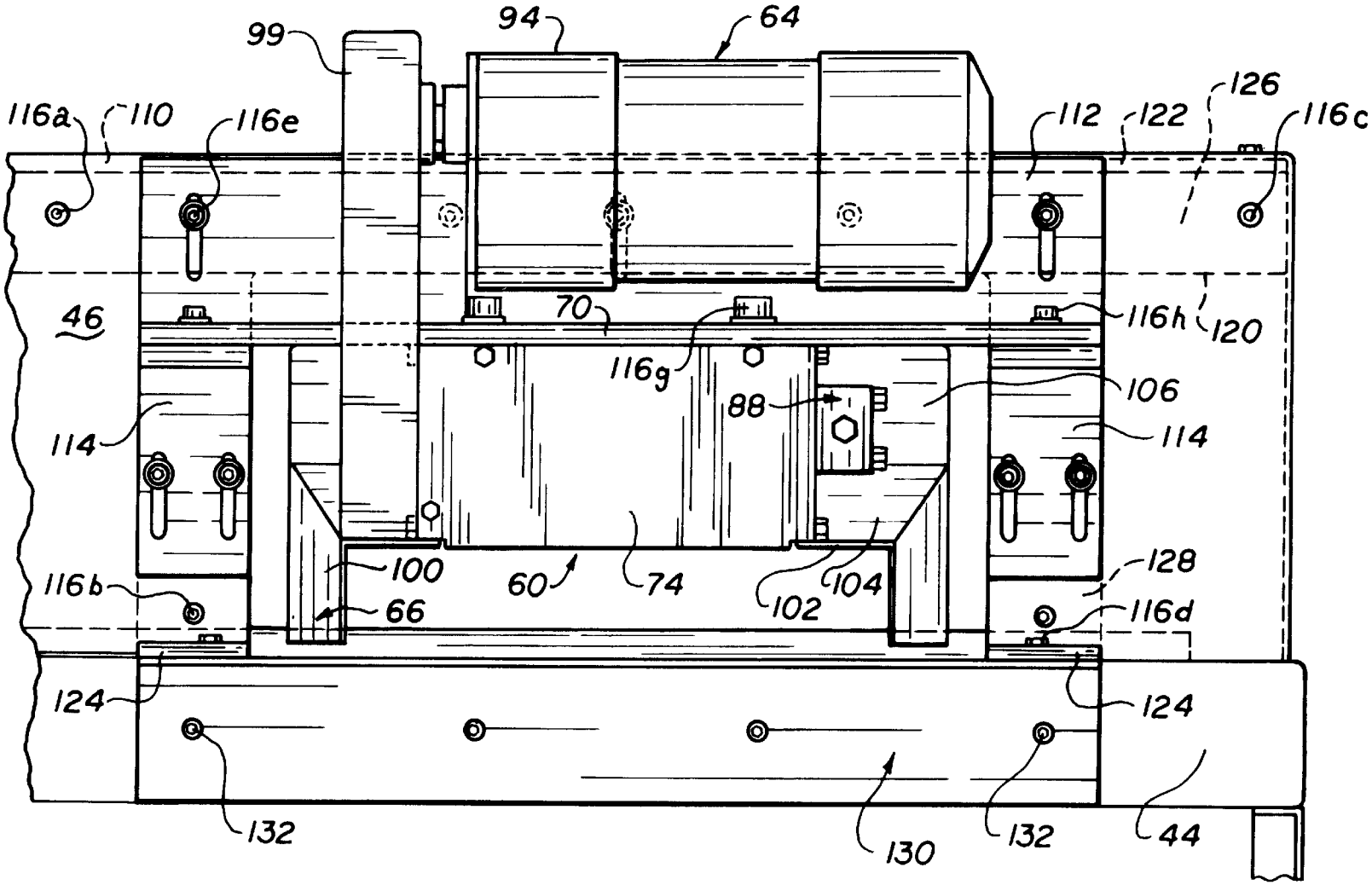
FIG. 8 is a front (downstream) view of the pad-transferring assembly, the assembly being shown mounted to the cushioning conversion machine by appropriate mounting members.
Figure 9:
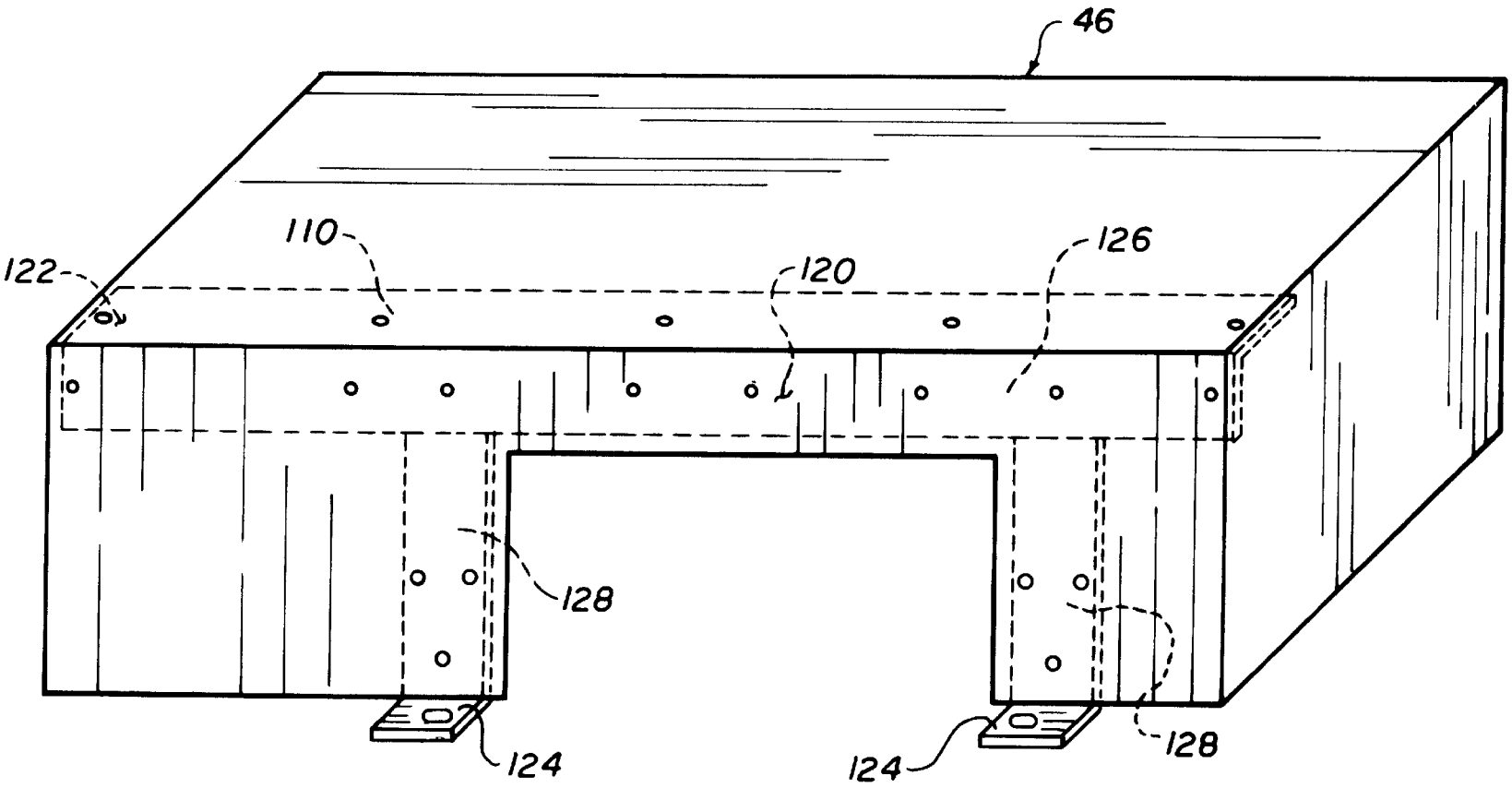
FIG. 9 is a perspective view of one component of the machine's frame and one of the mounting members.

Referring now to FIGS. 7–9, the pad-transferring assembly 12 is shown mounted to the machine frame 36 or, more particularly, the tunnel-forming components 44 and 46 of the frame extension 37. This mounting is accomplished by a mounting plate 110, a top mounting bracket 112, a pair of bottom mounting brackets 114, and a series of coupling elements 116*a*–116*h*. Specifically, the mounting plate 110 is coupled to the machine frame 36, the top and bottom brackets 112 and 114 are coupled to mounting plate 110, and the top bracket 112 is coupled to the pad-transferring assembly 12. The top and bottom brackets 112 and 114 are also coupled to each other and are arranged so that the bottom brackets 114 can function as a braces for the top bracket 112.

The one-piece mounting plate 110 includes a horizontal mounting surface 120, a top vertical flange 122, and a pair of bottom vertical flanges 124. As is best seen in FIG. 9, the mounting surface 120 is located on an inside surface of the end wall of the casing 46. The geometry of the mounting surface 120 is chosen to accommodate the coupling of the brackets 112 and 114 thereto and also to reinforce the casing 46, particularly its end wall. To this end, the mounting surface 120 includes a laterally-extending section 126 and two vertically-extending sections 128.

The laterally-extending section 126 extends downward from the top vertical flange 122. The two vertically-extending sections 128 extend between intermediate regions of the laterally-extending section 126 and the bottom vertical flanges 124. Specifically, the vertically-extending sections 128 are positioned adjacent the lateral edges of the casing's outlet opening. (See FIG. 9.) As is best seen in FIG. 8, the sections 126 and 128 may be coupled to the casing 46 by capscrews 116*a* and 116*b,* respectively.

The top vertical flange 122 is attached to the upper wall of the casing 46 by capscrews 116*c.* The bottom vertical flanges 124 project outwardly from the tunnel 47 and are attached to the upper surface of the shelf 44 by capscrews 116*d.* (See FIG. 7.) Thus, capscrews 116*a*–116*d* couple the mounting plate 110 to the machine frame 36.

The top mounting bracket 112 has a "backwards L" sectional geometry and each of the bottom brackets 114 has an "upside-down L" sectional geometry. (See FIG. 7.) The top mounting bracket 112, which spans the distance between the two vertically-extending sections 128, is coupled to the laterally-extending section 126 (and also the casing 46) by capscrews 116*e* extending through the vertical leg of the bracket 112. (See FIG. 8.) The bottom brackets 114 are of substantially the same width as the vertically-extending sections 128 and they are coupled thereto (and also the casing 46) by capscrews 116*f* extending through the bracket's horizontal legs. In this manner, the top and bottom brackets 112 and 114 are coupled to the mounting plate 110, and, consequently, to the machine frame 36. Preferably, vertically elongated slots are used in conjunction with the capscrews 116*e* and 116*f* for selective up/down adjustments of the brackets 112 and 114 (and thus the pad-transferring assembly 12) relative to the mounting plate 110 (and thus the tunnel 47 or the machine frame 36).

The top mounting bracket 112 is coupled to the top support plate 70 by capscrews 116*e* which extend through the bracket's horizontal leg. (Thus, the pad-transferring assembly 12 is hung in a cantilever fashion from the frame extension 43.) In this manner, the pad-transferring assembly 12 is coupled to the top mounting bracket 112 whereby it is coupled to the mounting plate 110 and therefore the machine frame 36.

As was indicated above, the top and bottom brackets 112 and 114 are coupled to each other and are arranged so that the bottom mounting brackets 114 can function as a braces for the top mounting bracket 112. Specifically, the brackets 112 and 114 are coupled to each other by capscrews 116*f* extending through their horizontal legs. (See FIG. 8.) As is best seen in FIG. 7, this arrangement allows the bottom brackets 114 to share the load of the cantilevered pad-transferring assembly 12.

The cushioning conversion machine 10 may further include a transitional ledge 130. The transition ledge 130 has an "upside-down L" cross sectional geometry, with its vertical leg being attached to the downstream edge of the shelf 44 by a capscrews 132. This attachment is accomplished so that the ledge's horizontal leg is flush with the upper surface of the shelf 44 and projects outwardly therefrom. In this manner, the transitional ledge 130 forms a smooth transition surface between the shelf 44 and the pad-transfer assembly 12. (See FIG. 7.)

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A cushioning conversion machine comprising:

a frame having an upstream end and a downstream end;

conversion assemblies, mounted to the frame, which convert a sheet-like stock material into a continuous three-dimensional strip of cushioning product;

a cutting assembly, mounted to the frame downstream of the conversion assemblies, which cuts a leading portion of the strip into a cut pad of a desired length; and a pad-transferring assembly, mounted to the frame downstream of the cutting assembly, which pulls the cut pad away from the cutting assembly;

wherein the machine's frame includes an exit opening through which the strip of cushioning product is emitted and wherein the pad-transferring assembly further comprises a guide unit which forms a chute which guides the cut pad as it is being transferred away from the cutting assembly, the entry of the guide unit being aligned with the exit opening.

2. A cushioning conversion machine as set forth in claim 1 wherein the pad-transferring assembly pulls the leading portion of the strip prior to it being cut.

3. A method of producing a cut pad comprising the steps of providing a sheet-like stock material and using the cushioning conversion machine of claim 1 to convert the sheet-like stock material into a cut pad.

4. A method as set forth in claim 3 wherein the sheet-like stock material is biodegradable, recyclable, and reusable.

5. A method as set forth in claim 4 wherein the sheet-like stock material is Kraft paper.

6. A method as set forth in claim 5 wherein the sheet-like stock material comprises multiple plies of Kraft paper.

7. A method as set forth in claim 6 wherein the sheet-like stock material comprises a roll of three superimposed plies of Kraft paper.

8. A cushioning conversion machine comprising:

a frame having an upstream end and a downstream end;

conversion assemblies, mounted to the frame, which convert a sheet-like stock material into a continuous three-dimensional strip of cushioning product;

a cutting assembly, mounted to the frame downstream of the conversion assemblies, which cuts a leading portion of the strip into a cut pad of a desired length; and a pad-transferring assembly, mounted to the frame downstream of the cutting assembly, which pulls the cut pad away from the cutting assembly;

wherein the pad-transferring assembly comprises a conveyor, said conveyor comprising a belt wrapped around a series of rollers, which frictionally engages the strip prior to it being cut and frictionally transfers the cut pad away from the cutting assembly; wherein the machine's frame includes an exit opening through which the strip of cushioning product is emitted; and wherein the pad-transferring assembly further comprises a guide unit which forms a bottomless chute below the conveyor and which guides the cut pad as it is being transferred away from the cutting assembly, the entry of the guide unit being aligned with the exit opening.

* * * * *